US009470069B2

(12) United States Patent
Stubbeman

(10) Patent No.: US 9,470,069 B2
(45) Date of Patent: Oct. 18, 2016

(54) SUBSEA WELL ASSEMBLY AND ASSOCIATED METHOD

(75) Inventor: Robert Stubbeman, Oslo (NO)

(73) Assignee: Aker Subsea AS, Lysaker (NO)

( * ) Notice: Subject to any disclaimer, the term of this patent is extended or adjusted under 35 U.S.C. 154(b) by 49 days.

(21) Appl. No.: 14/113,285

(22) PCT Filed: Apr. 26, 2012

(86) PCT No.: PCT/NO2012/050078

§ 371 (c)(1),
(2), (4) Date: Oct. 22, 2013

(87) PCT Pub. No.: WO2012/148288

PCT Pub. Date: Nov. 1, 2012

(65) Prior Publication Data

US 2014/0048278 A1 Feb. 20, 2014

(30) Foreign Application Priority Data

Apr. 28, 2011 (NO) ..... 20110631

(51) Int. Cl.

| | |
|---|---|
| ***E21B 34/04*** | (2006.01) |
| ***E21B 43/01*** | (2006.01) |
| ***E21B 33/035*** | (2006.01) |
| ***E21B 33/076*** | (2006.01) |
| ***E21B 43/12*** | (2006.01) |

(52) U.S. Cl.

CPC ..... *E21B 43/01* (2013.01); *E21B 33/035* (2013.01); *E21B 33/076* (2013.01); *E21B 34/04* (2013.01); *E21B 43/128* (2013.01)

(58) Field of Classification Search

CPC ..... E21B 33/035; E21B 33/043

USPC ..... 166/368, 348

See application file for complete search history.

(56) References Cited

U.S. PATENT DOCUMENTS 3,638,732 A * 2/1972 Huntsinger et al. ..... 166/379
4,607,701 A * 8/1986 Gundersen ..... 166/368

(Continued)

FOREIGN PATENT DOCUMENTS

| | | | |
|---|---|---|---|
| EP | 0611874 | A1 | 8/1994 |
| WO | WO-0181710 | A1 | 11/2001 |
| WO | WO-2014/074616 | A1 | 5/2014 |

OTHER PUBLICATIONS

Al-Amiri, Thamir J., "International Search Report," prepared for PCT/NO2012/050078, as mailed Jul. 12, 2012, 3 pages.

(Continued)

*Primary Examiner* — Matthew R Buck
*Assistant Examiner* — Aaron Lembo
(74) *Attorney, Agent, or Firm* — Rothwell, Figg, Ernst & Manbeck, P.C.

(57) ABSTRACT

Subsea well assembly having a Xmas tree (107, 207) and wellhead (103). From a tubing hanger (113) a tubing extends into the well. A part of a production flow passage extends vertically from the tubing hanger (113) in a vertical bore (111) of the Xmas tree. A fail close production master valve (PMV) (117) is arranged in the production flow passage. The tubing hanger (113) is arranged below the Xmas tree (107), such as in the wellhead (103). The Xmas tree (107) exhibits a branch (115) that deviates from the vertical bore (111), which branch constitutes part of the production flow passage. The fail close type production master valve (PMV) (117) is arranged in the branch (115).

15 Claims, 6 Drawing Sheets

(56) References Cited

U.S. PATENT DOCUMENTS

| | | | | |
|---|---|---|---|---|
| 4,804,045 | A * | 2/1989 | Reed | 166/65.1 |
| 6,227,300 | B1 * | 5/2001 | Cunningham | E21B 33/035 166/339 |
| RE37,995 | E * | 2/2003 | Barrus et al. | 417/410.3 |
| 7,150,325 | B2 * | 12/2006 | Ireland et al. | 166/366 |
| 7,201,229 | B2 * | 4/2007 | White | E21B 43/01 166/344 |
| 7,331,396 | B2 * | 2/2008 | Reimert et al. | 166/368 |
| 7,677,320 | B2 * | 3/2010 | Shaw et al. | 166/368 |
| 7,699,099 | B2 * | 4/2010 | Bolding et al. | 166/89.1 |
| 8,066,063 | B2 * | 11/2011 | Donald et al. | 166/88.4 |
| 8,689,879 | B2 * | 4/2014 | Patel et al. | 166/348 |
| 8,752,632 | B2 * | 6/2014 | AgerbæK | 166/344 |
| 8,794,334 | B2 * | 8/2014 | June | 166/368 |
| 2003/0102135 | A1 | 6/2003 | Baskett et al. | |
| 2007/0246220 | A1 | 10/2007 | Fenton | |
| 2007/0289747 | A1 | 12/2007 | Shaw et al. | |
| 2010/0300700 | A1 * | 12/2010 | Garbett | E21B 33/038 166/368 |

OTHER PUBLICATIONS

Office Action issued in Chinese Patent Application No. 201280020550.9, Jul. 2, 2015, 17 pgs.

* cited by examiner

SUBSEA WELL ASSEMBLY AND ASSOCIATED METHOD

The present invention relates to a subsea well assembly adapted for production from a subsea hydrocarbon well. In particular, the invention relates to a subsea well assembly, including a wellhead and a Xmas tree which is adapted for production assisted with an electric submersible pump (ESP).

BACKGROUND

In the field of subsea hydrocarbon wells, it is known to distinguish between conventional or vertical Xmas trees (XT) on one hand and horizontal trees on the other hand. Traditionally, a vertical XT has a production flow passage extending through a vertical bore of the tree. Installed in the vertical production flow is a production master valve (PMV) adapted to open and close the passage. The PMV is hydraulically controlled and provided with a fail close mechanism. If the hydraulic pressure drops, the PMV will close. Another characteristic of vertical XT's is that the tubing hanger (TH) from which a production tubing suspends and extends into the well, is arranged in the well head below the XT.

Common for both vertical and horizontal XT's is a horizontal flow passage that branches out from the vertical bore. However, while the vertical tree has the PMV in the vertical bore the horizontal XT's have the PMV arranged in the horizontal flow passage. Another difference from the vertical tree is that the tubing hanger is installed within the vertical bore of the tree, instead of below the tree, such as in a wellhead or a tubing head spool.

A traditional consequence of the features of the vertical XT is that the operator can remove the tree without removing the TH. However he cannot remove the TH without removing the tree. Contrary to this, the traditional consequence of the features of the horizontal XT is that the operator cannot remove the tree without removing the TH, but can remove the tubing hanger without removing the tree.

There are various solutions which address these drawbacks. Patent publication EP 0611874 B1 describes a subsea wellhead assembly adapted in such way that the operator can remove the tubing without removing the Xmas tree, and remove the Xmas tree without removing the tubing. The tubing is suspended in a lower tubing hanger arranged in the wellhead housing. The tubing can be removed through the tree and a blowout preventer (BOP). When removing the tree, a plug is set in the lower tubing hanger within the wellhead housing. During production, the production flow is guided from the lower tubing hanger up to an upper tubing hanger that exhibits a lateral port that registers with an outlet port in the tree. The upper tubing hanger (referred to as a false tubing hanger) and a tree cap installed in the tree constitute two barriers.

US patent application publication US2007246220 also describes a subsea wellhead assembly having a tubing hanger in the wellhead housing. A spool, being part of a XT assembly, lands on the wellhead. A tree cap extends into the bore of the spool. A lateral passage of the tree cap aligns with a lateral port of the spool, through which fluid flows during production.

Patent publication U.S. Pat. No. 7,677,320 describes the use of an electrical pump lowered into the tubing when the downhole pressure becomes low. The tubing comprises a downhole safety valve which is closed during installation of the pump. It has a tubing hanger arranged in the XT. The tubing hanger has a port aligned with a horizontal outlet passage in the XT.

THE INVENTION

According to a first aspect of the present invention, there is provided a subsea well assembly having a Xmas tree and wellhead. The assembly further comprises a tubing hanger from which a tubing is suspended and extended into the well, and a production flow passage of which a part extends vertically upwards from the tubing hanger in a vertical bore of the Xmas tree. A fail close type production master valve (PMV) is arranged in the production flow passage. According to the first aspect of the invention, the tubing hanger is arranged below the Xmas tree, such as in the wellhead or a tubing spool. The Xmas tree exhibits a branch that deviates from the vertical bore, which branch constitutes part of the production flow passage. Furthermore, the fail close type production master valve (PMV) is arranged in the branch.

The fail close type PMV is biased to close, such as by a spring, if the actuation signal, such as a hydraulic pressure, is removed.

In one embodiment the production flow passage through the Xmas tree is in direct contact with said vertical bore of the Xmas tree.

The production flow passage through the Xmas tree being in direct contact with the vertical bore of the Xmas tree, means that there is no sleeve or additional pipe or tube, through which the flow passage extends within the vertical bore of the Xmas tree. That is, the flow passage is partly formed by this vertical bore and not by another component arranged within this vertical bore. The fluid flowing through the flow passage is thus in direct contact with this part of the vertical bore.

The subsea well assembly according to the first aspect of the present invention can comprise a plug profile in a top section of the vertical bore. Such a plug profile may be used for installation of a plug which constitutes a barrier between the production flow and the environment. The plug may also exhibit other advantageous features, as will be described further below.

During production, the first barriers above the tubing hanger can be a barrier located in the vertical bore, below the plug profile and above the branch, as well as a barrier located in the branch.

Furthermore, the first barrier above the tubing hanger and located in the vertical bore and above the branch can be a production swab valve (PSV). Such a valve is operated by operator (not fail close), either by means of an actuator controlled by the operator, or mechanically, such as by means of a remotely operated vehicle (ROV).

A manually operated, fail-in-place master valve can be arranged in the vertical bore, below the branch. Such a valve is also controlled by the operator (i.e. not fail close). With the term fail-in-place valve is meant a valve that does not open or close further after the moment it fails.

Furthermore, a master valve can be arranged in the vertical bore, below the branch, while two valves can be located in the branch.

A plug can be installed in the plug profile and a suspension string, such as a coiled tubing or cable, can extend from the plug, through the primary swab valve (PSV), the vertical bore of the Xmas tree, the tubing hanger, and down into the tubing. In such an embodiment, an electrical submersible pump (ESP) can be attached to the suspension string in a downhole position and within the tubing, and be adapted to pump fluid upwards through the tubing.

Furthermore, with the embodiment including the ESP above, a tree cap can be installed in the upper part of the Xmas tree, and electrical and/or optical communication with the ESP can then be provided through the suspension string, the plug, an electrical interface between the plug and the tree cap, and a communication line extending from the tree cap. Within the term electrical communication is included electrical power supply.

According to a second aspect of the second invention, there is provided a method of producing a hydrocarbon-containing fluid from a subsea well, including the following steps:

a) lowering, on a suspension string, an electrical submersible pump down into a production tubing that extends into the well from a tubing hanger installed in a wellhead or in a tubing head spool;
b) suspending the electrical submersible pump, through the suspension string, with a suspension plug, and installing the plug in a plug profile in the upper section of a vertical bore of a Xmas tree landed on or above the wellhead, wherein the suspension string extends through an open valve or valves in the vertical bore;
c) arranging a tree cap to the Xmas tree, above the plug, and connecting electrical and/or optical conductors of the tree cap to conductors of the plug, thereby establishing an electrical and/or optical connection from the tree cap to the electrical submersible pump.

According to the second aspect of the present invention, the method further comprises the following steps:

d) opening a fail close type production master valve in a branch that deviates from the vertical bore of the Xmas tree, which branch constitutes part of a production flow passage through the Xmas tree and is arranged below said plug profile;
e) driving the electrical pump, thereby bringing about or increasing fluid flow upwards through the production tubing and production flow passage.

According to the invention, there is an open valve in the vertical bore in a position above the branch and below the plug.

Moving the production master valve from the vertical bore of the Xmas tree, as in the prior art, to the branch of the Xmas tree, according to the first aspect of the present invention, makes it possible to use the production master valve even if an electric cable extends through the vertical bore of the Xmas tree, down to an electric submersible pump in the well.

EXAMPLE OF EMBODIMENT

Having described the invention in general terms above, a non-limiting description of various embodiments will be given in the following with reference to the drawings, in which FIG. 1 is a principle sketch of a subsea well assembly according to a first embodiment of the invention;

Figure 1:
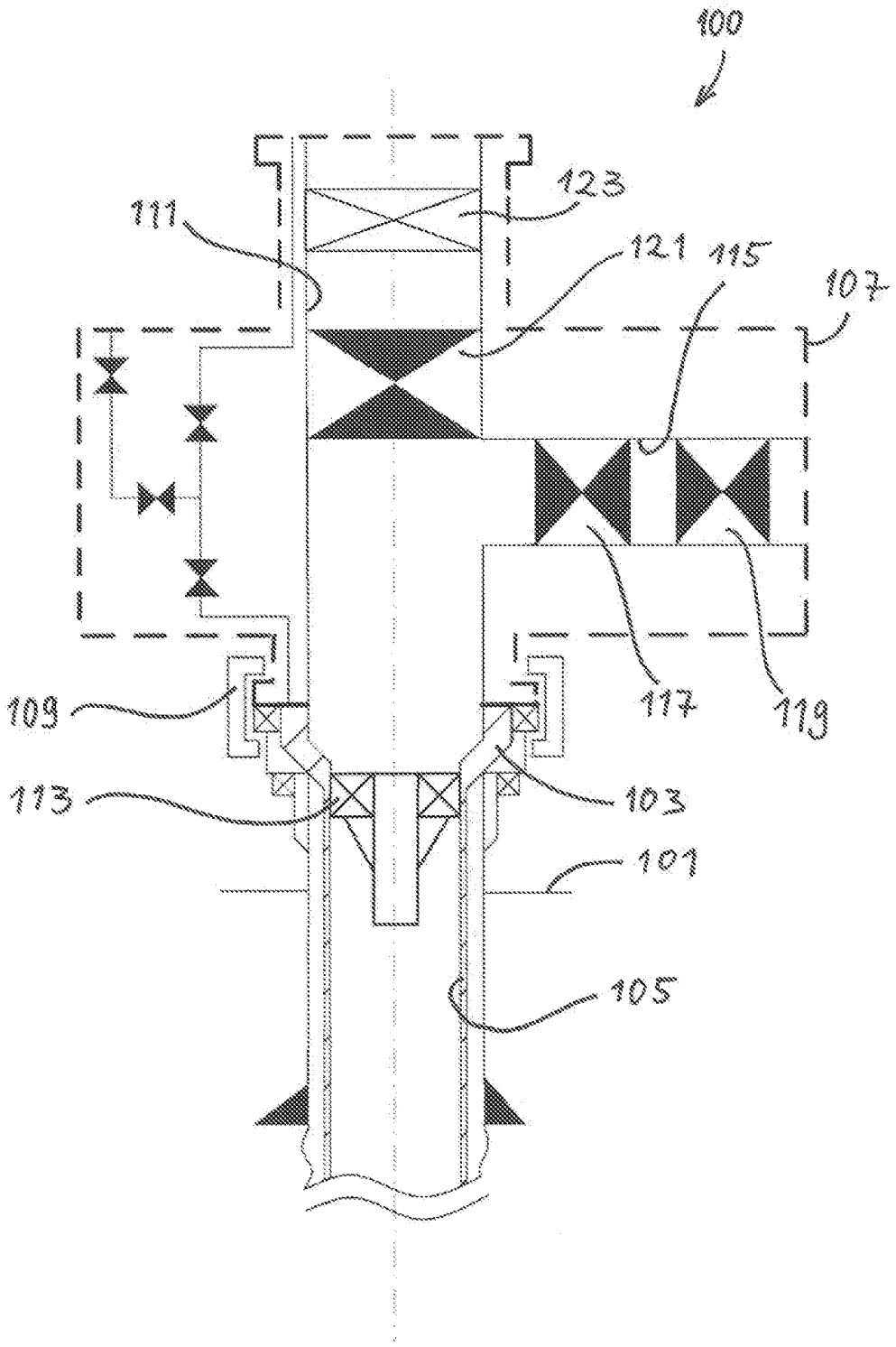

FIG. 1 shows a first embodiment of the present invention. A subsea well assembly 100 is installed on the seabed 101. It has a well head 103 from which a casing 105 extends into the seabed 101. A subsea Xmas tree 107 is connected to the well head 103 with a connection means 109. The Xmas tree 107 has a vertical bore 111 that aligns with the well head 103 and extends towards the top part of the Xmas tree 107.

Within the well head 103 there is arranged a tubing hanger 113 from which a production tubing (not shown) can depend and extend into the well. When producing from the well, production fluid flows upwards through the tubing and into the vertical bore 111 of the Xmas tree 107.

The vertical bore 111 of the Xmas tree 107 is in connection with a branch 115 that extends horizontally out from the vertical bore 111. The horizontal branch 115 constitutes part of the production flow passage through the Xmas tree 107. Hence, a fail close type primary master valve (PMV) 117 is arranged in the branch 115. As described above, the fail close type valve will close if hydraulic actuation pressure is lost, and thus close the flow passage. Downstream of the fail close type PMV 117 there is also arranged a production wing valve (PWV) 119 in the branch 115. The production wing valve 119 is also of the fail close type, and will constitute a back-up for the fail close type PMV 117.

Above the branch 115, the vertical bore 111 of the Xmas tree 107 is provided with a primary swab valve (PSV) 121. This valve may be a hydraulically operated gate valve or a manual valve which will be closed during production. Above the PSV 121 the vertical bore 111 has a plug profile 123, adapted to be engaged by a plug (not shown in FIG. 1). During normal production, the PSV 121 will be closed and will constitute the primary barrier between the production fluid flowing in the production passage (bore 111 and branch 115) and the environment. As a second barrier, one may either arrange a plug in the plug profile 123 or install a tree cap on the top of the Xmas tree 107.

In the left wing of the Xmas tree 107, opposite of the branch 115, there are various channels and valves associated with the annulus.

Figure 2:
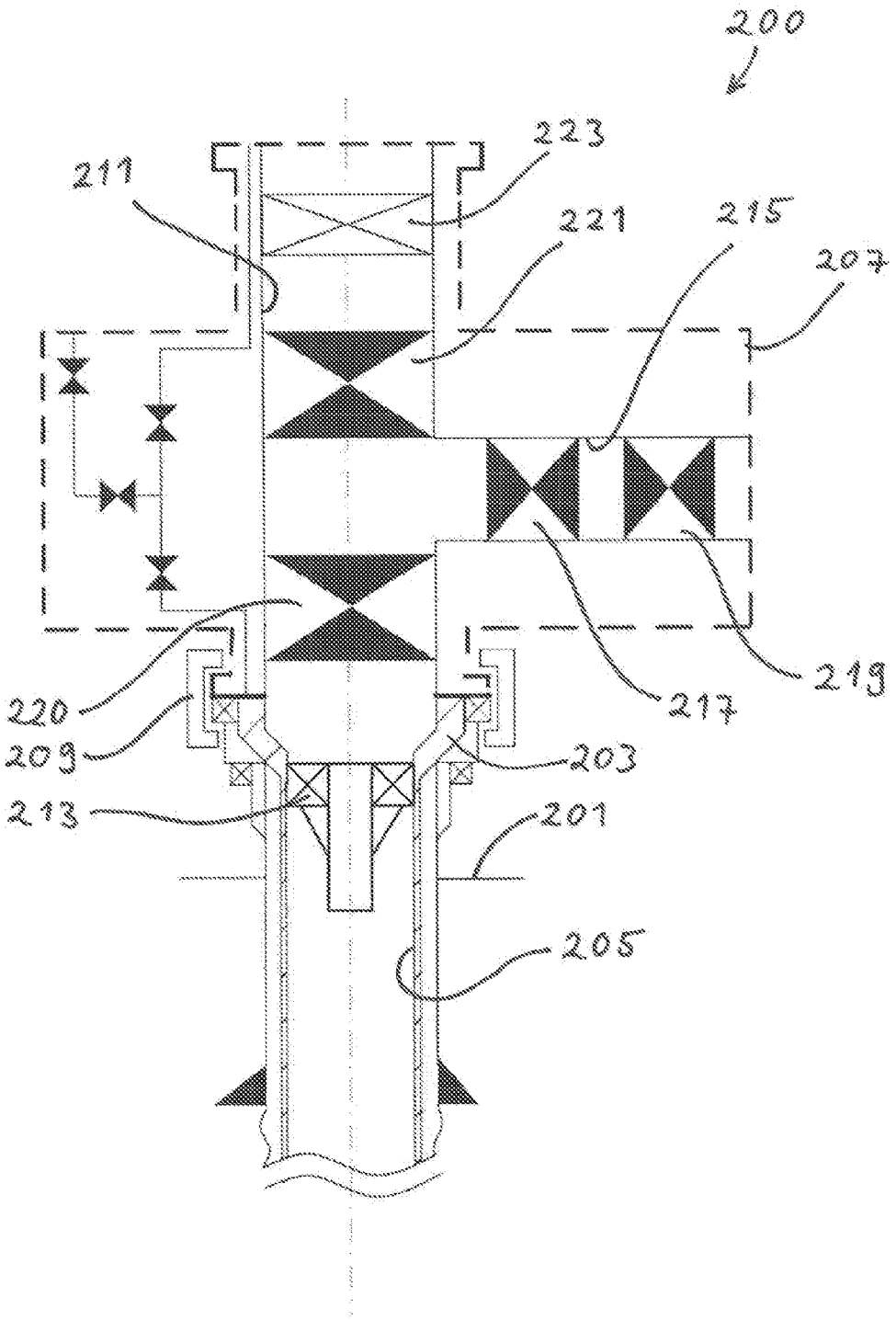
FIG. 2 is a principle sketch of a subsea well assembly according to a second embodiment of the invention.

FIG. 2 is a similar principle sketch illustrating a second embodiment of the present invention. This embodiment is also a subsea well assembly 200 according to the present invention. The assembly 200 is identical to the first embodiment described above with reference to FIG. 1, except that a lower production master valve 220 (lower PMV) is arranged, as an addition, in the vertical bore 111 of the Xmas tree 107, below the position of the branch 115. The lower PMV 220 is, for reasons to be described further below, not of fail close type. In stead, it is adapted to be opened and closed by the operator, such as by means of hydraulic control or by mechanical means.

The comparable components of the various embodiments in this specification are given corresponding reference numbers, except for the first digit. For instance, in this second embodiment, as illustrated in FIG. 2, the various components are designated with a three digit number, the first of which corresponds to the numbering of the embodiment, such as "2" in this second embodiment. As an example, the PSV in the first embodiment (FIG. 1) is designated as 121 while the PSV in the second embodiment (FIG. 2) is designated as 221.

Figure 3:
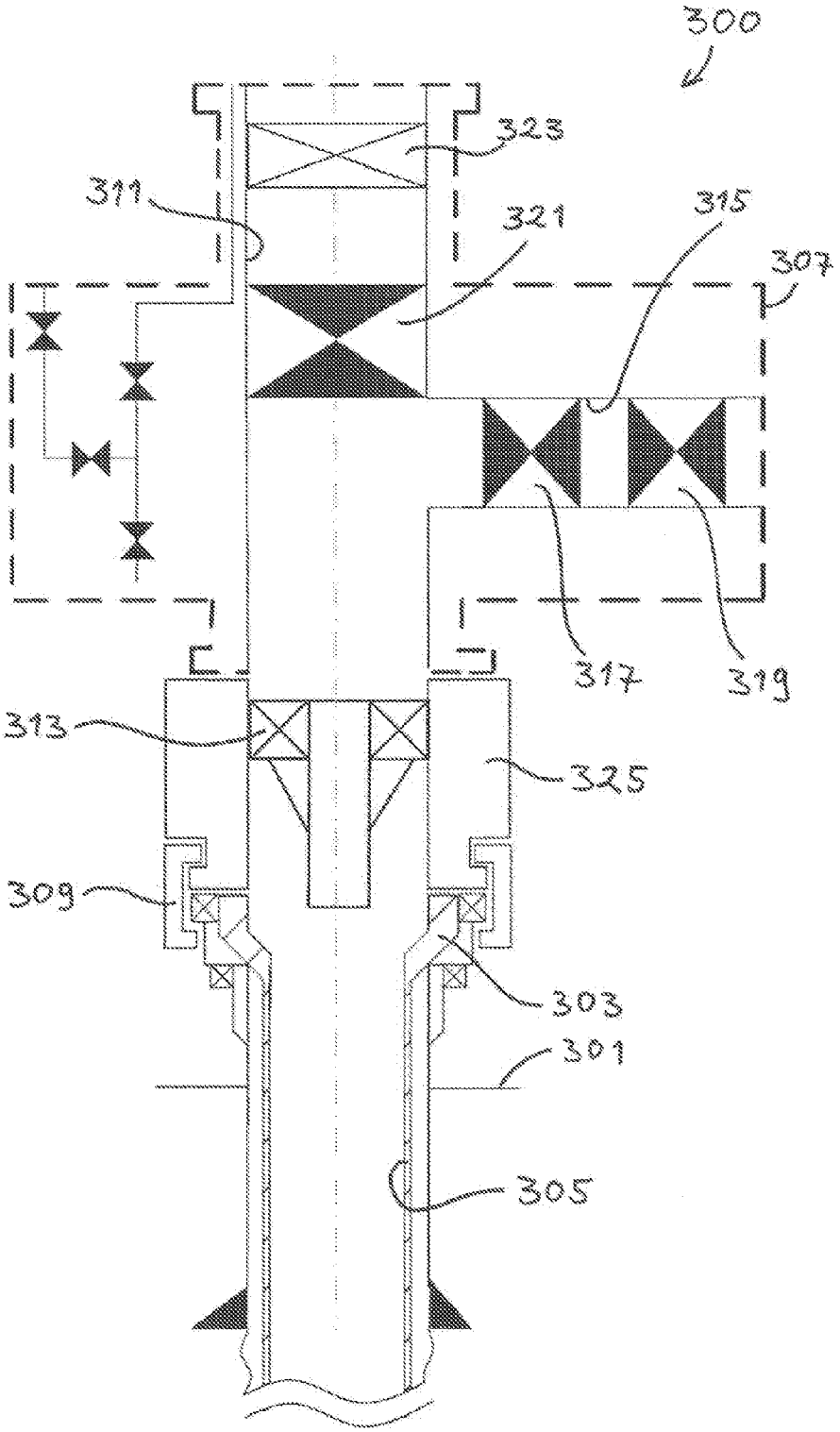
FIG. 3 is a principle sketch of a subsea well assembly according to yet another embodiment of the invention, wherein the assembly includes a tubing head spool.
Figure 4:
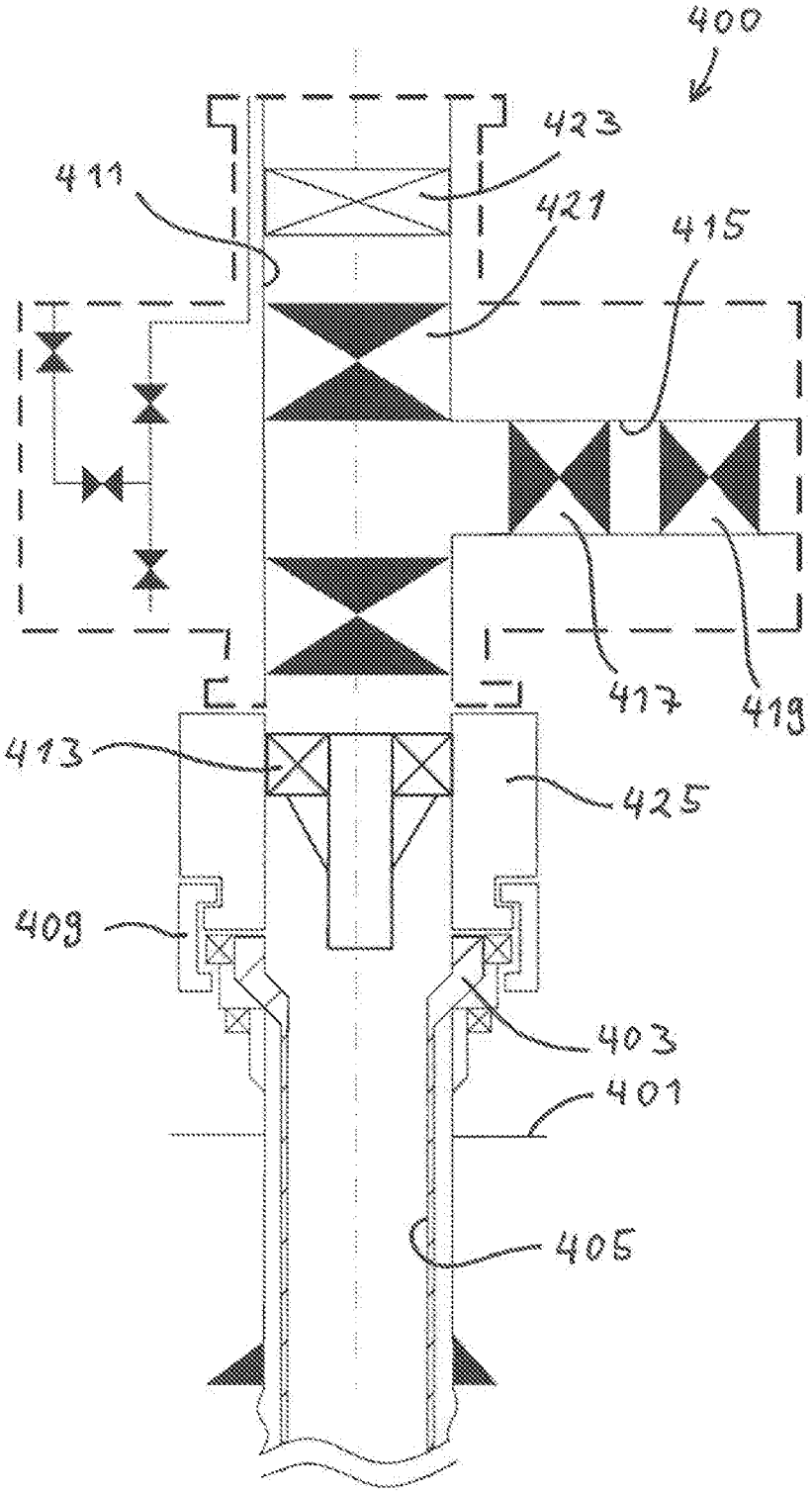
FIG. 4 is a principle sketch of a subsea well assembly according to yet another embodiment of the invention, wherein the assembly includes a tubing head spool.

FIG. 3 and FIG. 4 show a third and fourth embodiment of the present invention, which except for an added tubing spool 325, 425, substantially correspond to the first and second embodiment, respectively. As shown in FIG. 3 and FIG. 4, a tubing spool 325, 425 is added between the well head 303, 403 and the Xmas tree 307, 407. Furthermore, instead of landing the tubing hanger 313, 413 in the well head 303, 403, the tubing hanger 313, 413 is landed in the tubing spool 325, 425.

Having described various embodiments of the subsea well assembly according to the invention above, an application of the assembly will now be described, wherein an electrical submersible pump (ESP) is used to increase the flow through the production tubing.

ESP-ASSISTED PRODUCTION

Figure 5:
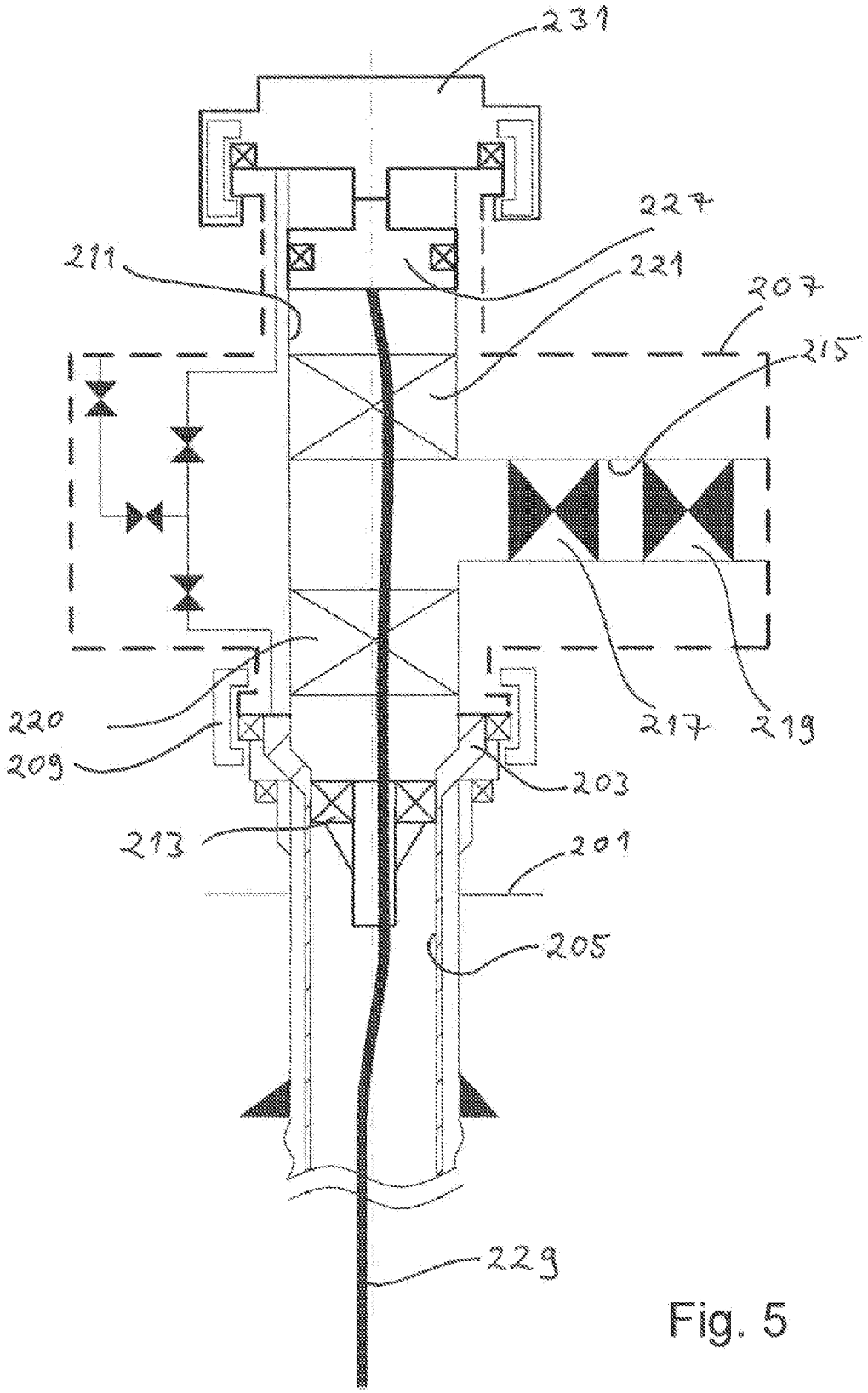
FIG. 5 is a principle sketch of the embodiment shown in FIG. 2, wherein an ESP (not shown) is suspended from the XT.

FIG. 5 illustrates the well assembly 200 described above with reference to FIG. 2, adapted for production with the aid of an ESP (not shown). In the plug profile 223 in the upper part of the vertical bore 211 of the Xmas tree 207, there is installed an ESP plug 227. From the ESP plug 227 a coiled tubing 229 is suspended. The coiled tubing 229 contains means by which to convey power and signal to the ESP. At the end of the coiled tubing 229 the ESP is arranged and adapted to pump fluid upwards through the tubing (not shown). The ESP is arranged within the bore of the tubing.

When the coiled tubing 229 extends through the Xmas tree 207 and its vertical bore 211 in this manner, the lower PMV 220 and the PSV 221 will be in open position. To prevent the lower PMV 220 from closing while the coiled tubing 229 extends through it, it is not of the fail close type, as discussed above.

When installing the ESP plug 227, a downhole safety valve arranged in the tubing, some distance into the well, is closed. A blow out preventer (BOP) (not shown) is landed on the Xmas tree 207. Then the ESP, suspended at the end of the coiled tubing 229, is lowered through the BOP, the vertical bore 211 of the Xmas tree, and down into the tubing suspended from the tubing hanger 213. At the upper end of the coiled tubing 229 is the ESP plug 227, which is locked to the plug profile 223 of the Xmas tree 207. The ESP plug 227 seals against the vertical bore 211 and makes, together with the closed downhole safety valve, two barriers. The BOP is then removed, and a tree cap 231 is landed and sealed to the upper part of the Xmas tree 207. Electrical wet-mate connectors (not shown) constitute an electrical interface between the ESP plug 227 and the tree cap 231. An electrical cable (not shown) extends from the tree cap 231, through which the operator can control the ESP.

Opening the PWV 219 and the PMV 217 in the branch 215, which valves have been closed during installation of the ESP, opens the branch 215 for production flow.

It should be noted that the described embodiment with the ESP also is employable with the first, third and fourth embodiment described above, that is without the lower PMV 220 and with or without a tubing spool 325, 425. In addition, the ESP could also be cable-suspended.

Figure 6:
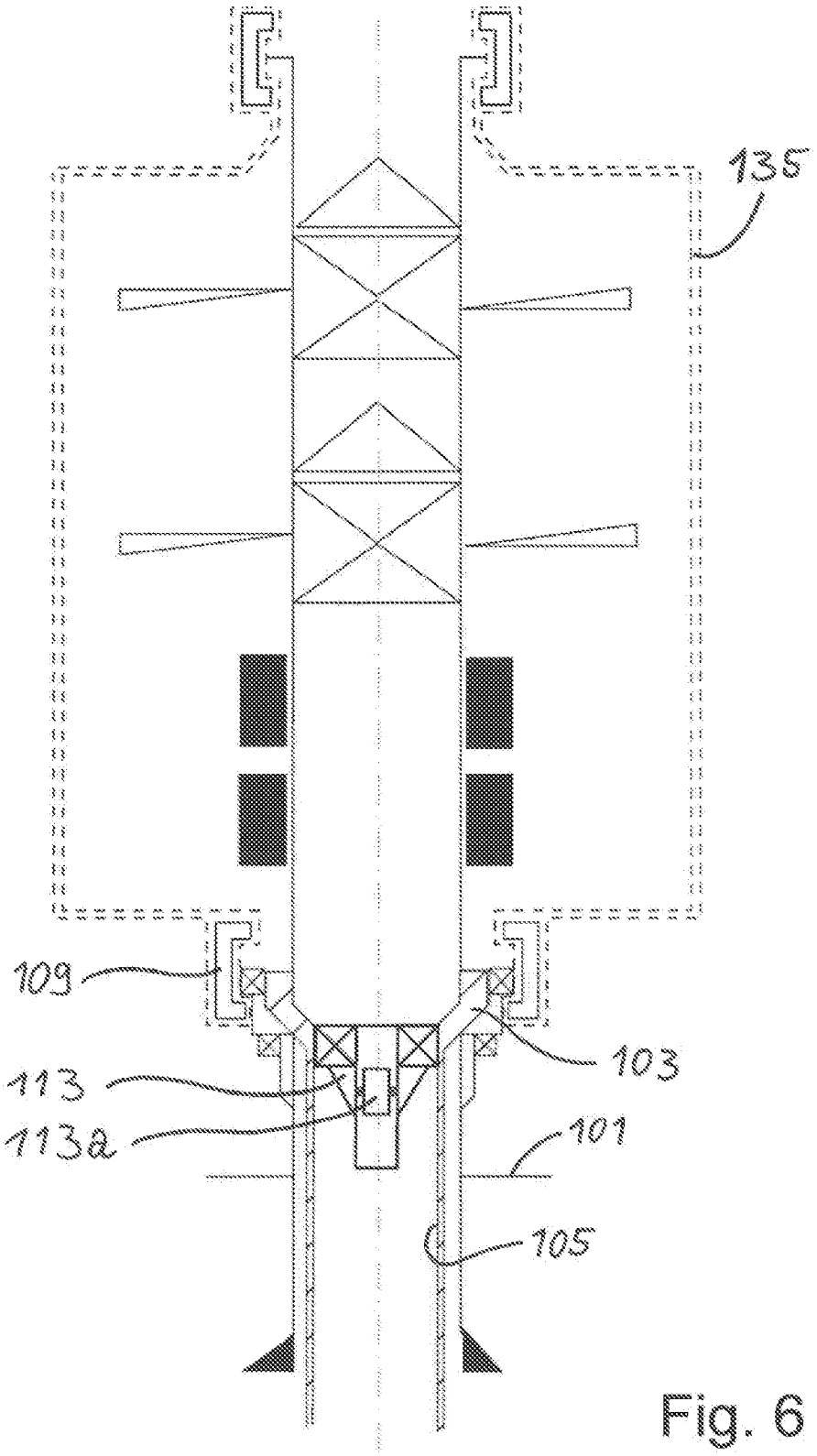
FIG. 6 is a principle sketch of the assembly shown in FIG. 1, however with the XT removed and with a blowout preventer landed on the wellhead.

FIG. 6 illustrates a situation wherein the tubing hanger 113 is being installed in the wellhead 103. In this situation the Xmas tree 107 is not yet landed onto the wellhead 103. Within the tubing hanger 113 there is arranged a removable wireline plug 113*a*. The tubing hanger 113 is installed through a blow out preventer (BOP) 135 landed on the wellhead 103.

The invention claimed is:

1. A method comprising:

providing a subsea xmas tree configured to connect to at least one of:

a wellhead located below the tree and comprising a tubing hanger, and a tubing spool located below the tree and comprising a tubing hanger;

the tree comprising:

a production flow passage having:

a vertical bore extending through the xmas tree from the wellhead or tubing spool through an upper part of the tree, and a branch that deviates from the vertical bore, the branch located below the upper part;

a plug profile in a top section of the vertical bore, the plug profile configured to lock an ESP plug such that the locked ESP plug seals the vertical bore, the ESP plug configured to control an Electric Submersible Pump (ESP);

a fail-close type production master valve in the branch; and a production wing valve in the branch, wherein the tree is connected to a wellhead or a tubing spool;

the method further comprising:

landing a BOP on top of the tree;

suspending an ESP in a downhole position below the tree via a suspension string connecting the ESP to the ESP plug; and removing the BOP.

2. The method of claim 1, wherein the production wing valve includes a fail-close type valve.

3. The method of claim 2, wherein the tree further comprises a fail-in-place valve in the vertical bore below the branch.

4. The method of claim 1, wherein the tree is configured to connect to a wellhead located below the tree and comprising a tubing hanger.

5. The method of claim 1, wherein the tree is configured to connect to a tubing spool located below the tree and comprising a tubing hanger.

6. The method of claim 1, wherein the tree further comprises a fail-in-place valve in the vertical bore below the branch.

7. The method of claim 1, wherein the tree further comprises a tree cap installed in the upper part and configured to form a barrier between the vertical bore and an environment external to the tree.

8. The method of claim 1, wherein the production flow passage does not comprise a sleeve, pipe, or tube within the vertical bore.

9. The method of claim 1, wherein the tree further comprises a primary swab valve in the vertical bore above the branch.

10. The method of claim 4, further comprising:

providing a subsea production assembly comprising:

a wellhead comprising a tubing hanger;

wherein the tree is connected to the wellhead;

an ESP plug locked into the plug profile; and an ESP suspended downhole below the tree via a suspension string connecting the ESP to the ESP plug.

11. The method of claim 10, wherein the subsea production assembly further comprises:

a tree cap installed in the upper part of the tree; and an electrical wet-mate connector connecting the ESP plug to the tree cap.

12. The method of claim 5, further comprising:

providing a subsea production assembly comprising:

a tubing spool connected to a wellhead and comprising a tubing hanger;

wherein the tree is connected to the tubing spool;

an ESP plug locked into the plug profile; and an ESP suspended downhole below the tree via a suspension string connecting the ESP to the ESP plug.

13. The method of claim 12, wherein the subsea production assembly further comprises:

a tree cap installed in the upper part of the tree; and an electrical wet-mate connector connecting the ESP plug to the tree cap.

14. The method of claim 1, further comprising connecting a tree cap to the upper part of the tree.

15. The method of claim 1, further comprising providing a subsea assembly comprising:

a wellhead comprising a tubing hanger, or a tubing spool connected to a wellhead and comprising a tubing hanger, and wherein the subsea xmas tree is connected to the wellhead or tubing spool;

wherein the subsea assembly further comprises:

an ESP plug locked into the plug profile; and an ESP suspended downhole below the tree via a suspension string connecting the ESP to the ESP plug;

the method further comprising:

opening the production master valve and production wing valve; and activating the ESP to aid production through the production flow passage.

* * * * *